US006091888A

United States Patent [19]

Jané et al.

[11] Patent Number: 6,091,888

[45] Date of Patent: Jul. 18, 2000

[54] PORTABLE ENVIRONMENTAL CONDITIONING DEVICE WITH PRESENCE DETECTOR RESPONSIVE SHUTOFF

[75] Inventors: Rodney B. Jané , Westborough; John Longan, Shrewsbury, both of Mass.; Jui-Shang Wang, Taipei, Taiwan; Steven L. Hecker, Waltham; Walter Birdsell, Shrewsbury, both of Mass.

[73] Assignee: Honeywell Consumer Products, Inc., Southborough, Mass.

[21] Appl. No.: 08/779,298

[22] Filed: Jan. 6, 1997

Related U.S. Application Data

[63] Continuation-in-part of application No. 08/441,346, May 15, 1995.

[51] Int. Cl.[7] ..... F24H 3/00

[52] U.S. Cl. ..... 392/365; 392/373; 392/375; 219/518; 340/540

[58] Field of Search ..... 392/373–376, 392/365–368, 360, 383, 370; 219/506, 518, 510; 340/589, 540; 165/200, 11.1; 236/47

[56] References Cited

U.S. PATENT DOCUMENTS

| | | | |
|---|---|---|---|
| 3,643,346 | 2/1972 | Lester | 34/202 |
| 4,315,596 | 2/1982 | Johnson, Jr. et al. | 165/11.1 |
| 4,485,864 | 12/1984 | Carrell et al. | 165/11.1 |
| 5,031,337 | 7/1991 | Pilolla et al. | 34/526 |
| 5,111,594 | 5/1992 | Allen | 392/380 |
| 5,163,234 | 11/1992 | Tsukamoto et al. | 392/380 |
| 5,278,936 | 1/1994 | Shao | 392/365 |
| 5,381,509 | 1/1995 | Mills | 392/376 |
| 5,437,001 | 7/1995 | Chaney et al. | 392/376 |
| 5,805,767 | 9/1998 | Jouas et al. | 392/373 |

FOREIGN PATENT DOCUMENTS

| | | |
|---|---|---|
| 2498439 | 7/1982 | France . |
| 3147085 | 6/1983 | Germany . |
| 57-49094 | 3/1982 | Japan . |
| 60-186630 | 9/1985 | Japan . |
| 2-143030 | 1/1990 | Japan . |
| 2-197727 | 8/1990 | Japan . |
| 4-98032 | 3/1992 | Japan . |
| 4-203846 | 7/1992 | Japan . |
| 6-142009 | 5/1994 | Japan . |
| 8-25943 | 1/1996 | Japan . |
| 10-19384 | 1/1998 | Japan . |

*Primary Examiner*—John A. Jeffery
*Attorney, Agent, or Firm*—John E. Toupal; Harold G. Jarcho

[57] ABSTRACT

An appliance includes a housing defining an air inlet and an air outlet facing opposite to the air inlet, an inlet detector for detecting objects in an inlet zone projecting away from the inlet and an outlet detector for detecting objects in an outlet zone projecting away from the outlet. Also included is a control for deactivating the appliance in response to detection of objects in either of the inlet or outlet zones.

19 Claims, 5 Drawing Sheets

PORTABLE ENVIRONMENTAL CONDITIONING DEVICE WITH PRESENCE DETECTOR RESPONSIVE SHUTOFF

CROSS-REFERENCE TO RELATED APPLICATION

This application is a continuation-in-part of U.S. patent application Ser. No. 08/441,346, entitled "PORTABLE ENVIRONMENTAL CONDITIONING DEVICE", filed May 15, 1995.

BACKGROUND OF THE INVENTION

This invention relates generally to an environmental conditioner device and, more particularly, to a portable environmental conditioner device having a safety shutoff control system.

Environmental conditioning devices such as portable electric heaters are used extensively to increase personal comfort in various types of environments. Typically, such heaters are equipped with a power cord for connection to a conventional power outlet and a on-off switch for controlling a resistive heating element. Safe operation of such heaters requires that they be energized only when in a predetermined orientation. For that reason, many heaters are provided with auxiliary tip-switches that prevent energization of the heating element with the heater in other than the predetermined operating orientation. Another problem associated with portable electric heaters is a tendency to become undesirably overheated in the event that inlet or outlet openings are obstructed. To prevent unsafe operation under those conditions, portable heaters generally are provided with thermostatically controlled switches that deenergize the heater element in the event of detected excessive temperature. Although providing important safety features, conventional tip-switches and overheat responsive thermostatic switches are relatively expensive and add significantly to the cost of a heater.

The object of this invention, therefore, is to provide an improved portable electric heater with a safety system that prevents unsafe operation of the types described above.

SUMMARY OF THE INVENTION

The invention is an electric appliance including a housing; an electrically powered environmental conditioner device retained by the housing and operable to produce air flow therethrough, and a supply for transmitting electrical power to the conditioner device. Also included are a sensor for detecting the presence of an object within a predetermined zone adjacent to the housing and a control for controlling the transmission of electrical power between the supply and the conditioner device in response to the sensor.

According to features of the invention, the appliance is a portable appliance, the supply includes an electrical plug for insertion into an electrical outlet socket, the housing defines an inlet for passing air thereinto and an outlet for discharging air therefrom, and the sensor includes an outlet detector for detecting the presence of an object within an outlet zone projecting away from the outlet. Proper operation is determined by the presence of objects adjacent to the outlet of the conditioner device.

According to another feature of the invention, the sensor also includes an inlet detector for detecting the presence of an object within an inlet zone projecting away from the inlet. Proper operation also is determined by objects adjacent to the inlet.

According to another feature of the invention, the control includes means operable to prevent the flow of electrical power to the conditioner device in response to detection of an object by the sensor. This feature prevents unsafe operation with objects closely adjacent to the device.

According to yet other features of the invention, the inlet and outlet are covered by grills and the control includes a deactivator for deactivating the inlet detector. The grills combine with the sensor and control to provide safe operation and the deactivator allows operation in circumstances wherein objects closely adjacent to the inlet are not undesirable.

According to still another feature of the invention, the conditioner device includes a rotatable fan blade for circulating air through the housing and an electric motor operatively coupled to the fan blade. This feature facilitates safe, controlled operation of a fan device.

According to a further feature of the invention, the conditioner device includes an electric beater element for heating air within the housing. This feature facilitates desirable operation of a portable electric heater device.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 2:
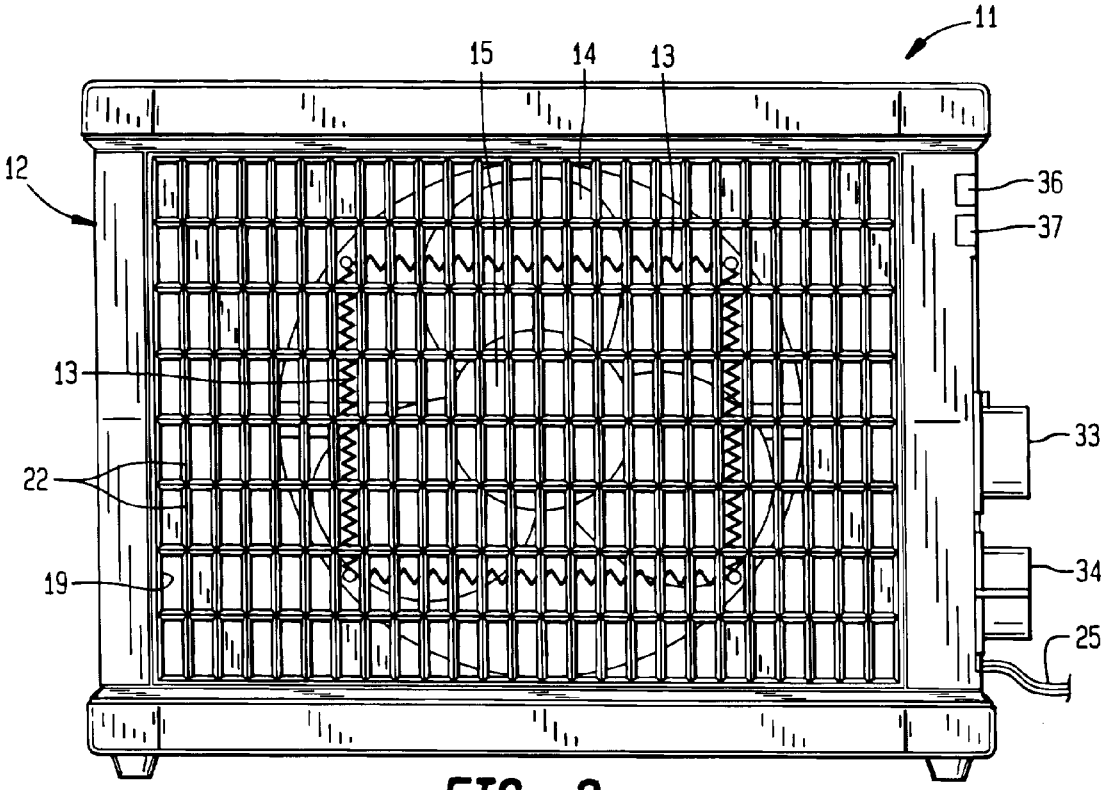
FIG. 2 is a front view of the device shown in FIG. 1.
Figure 3:
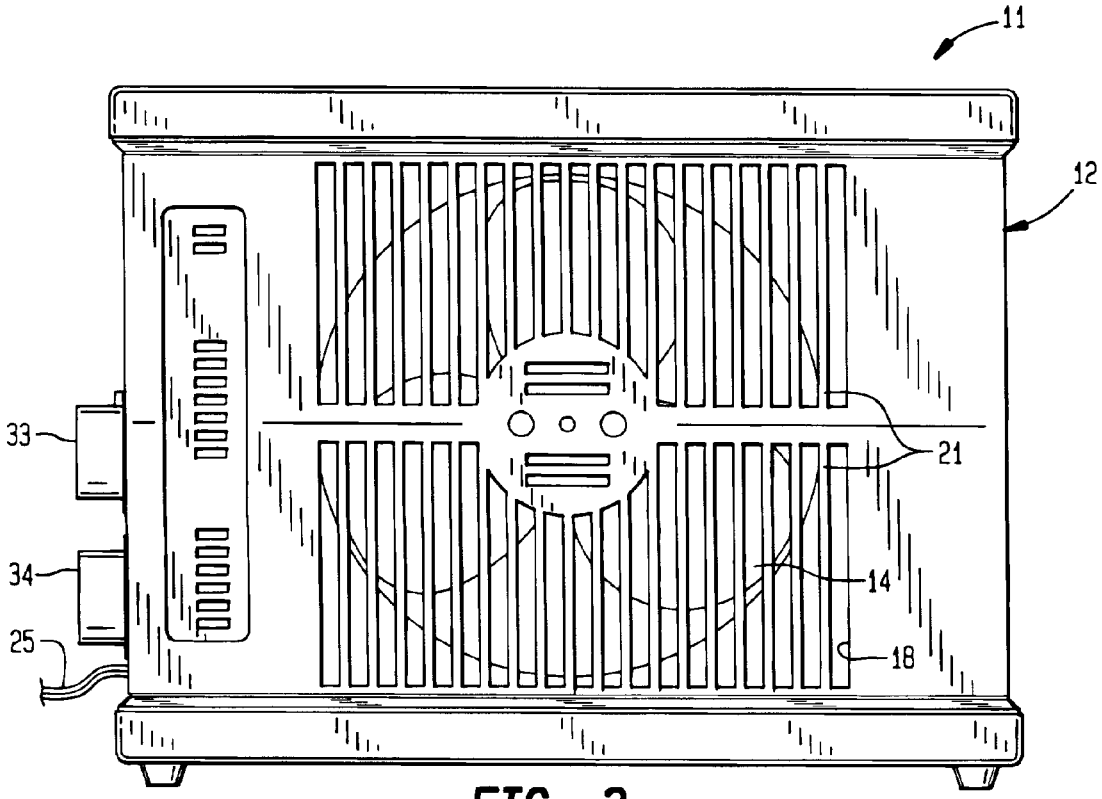
FIG. 3 is a rear view of the device shown in FIG. 1.

A portable, combination fan-heater device 11 is operable to alter surrounding environmental conditions. Included in the device 11 is a housing 12 retaining a resistive heater element 13 and a rotatable fan blade 14 coupled to an electric motor 15. Defined by the housing 12 is an inlet opening 18 (FIG. 3) for passing air thereinto and an outlet opening 19 (FIG. 2) for discharging air therefrom. The inlet opening 18 is covered by an inlet grill 21 and the outlet opening 19 is covered by an outlet grill 22. In response to energization of the electric motor 15, the rotating fan blade 14 draws air in through the inlet opening 18, by the resistive heater element 13 and out of the discharge opening 19.

Figure 1:
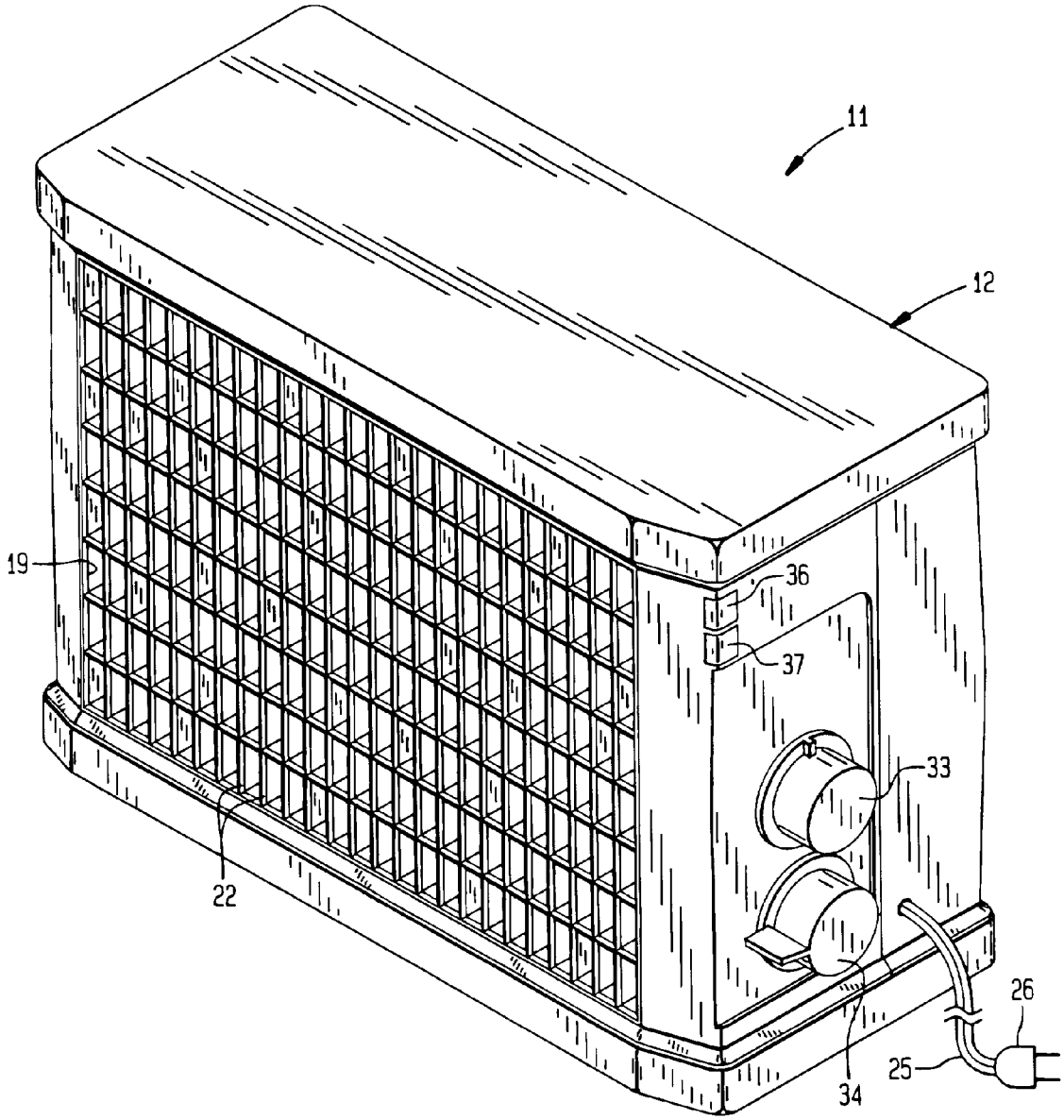
FIG. 1 is a perspective view of an environmental conditioning device according to the invention.
Figure 6:
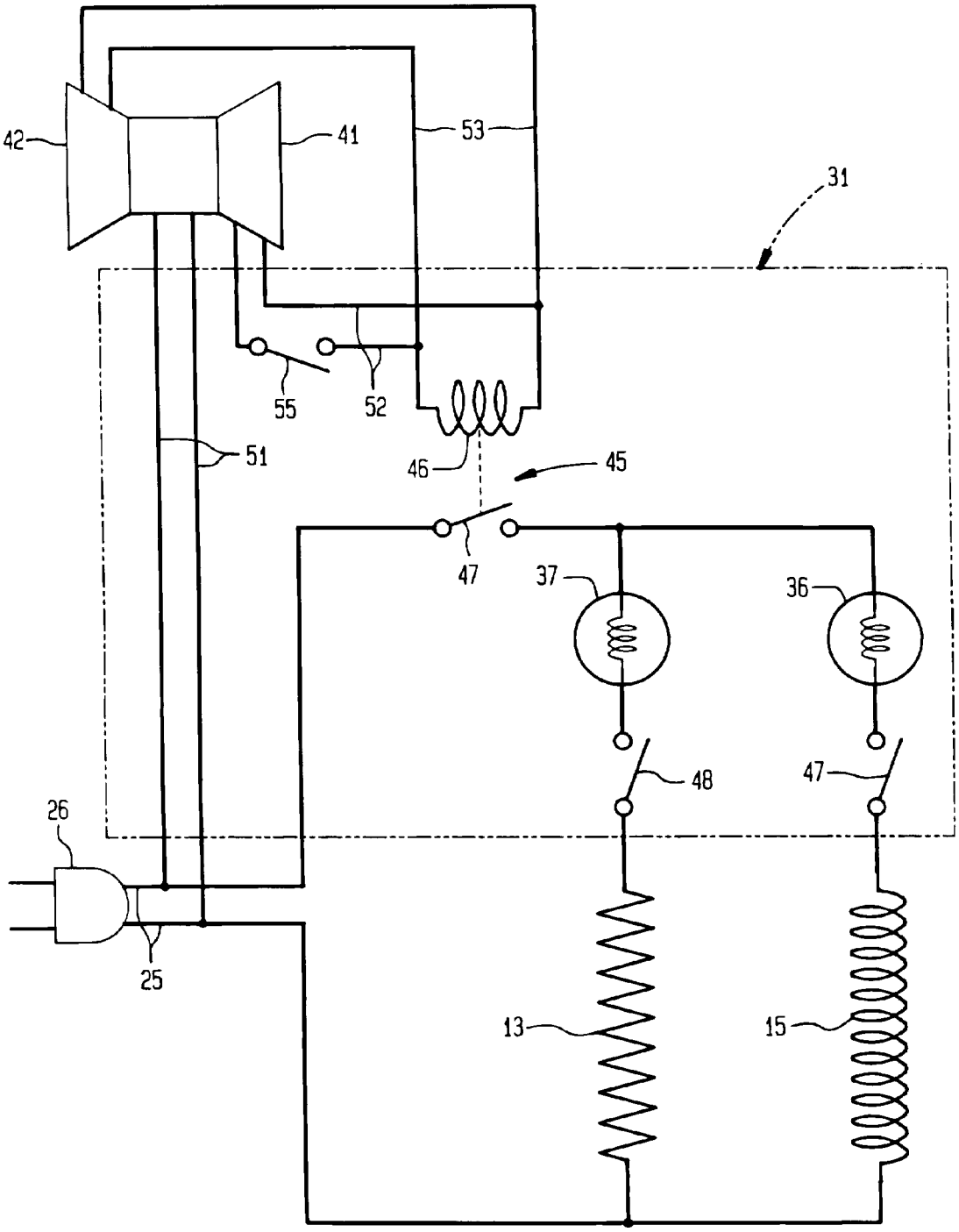
FIG. 6 is a schematic circuit diagram of a control system for the device shown in FIG. 1.

Also included with the device 11 is an electrical supply power cord 25 terminating with a plug 26 (FIG. 1) for insertion into a conventional power outlet socket (not shown) and a sensor assembly 28 and an electrical control circuit 31 (FIG. 4) both retained within the housing 12 and covered by a control panel 29. The control panel supports a fan control knob 33, a heater control knob 34, a fan power signal lamp 36 and a heater power signal lamp 37. As shown in FIG. 6, the control circuit 31 is interconnected with the power supply cord 25, the sensor assembly 28, the resistive heater element 13 and the electric motor 15.

Figure 4:
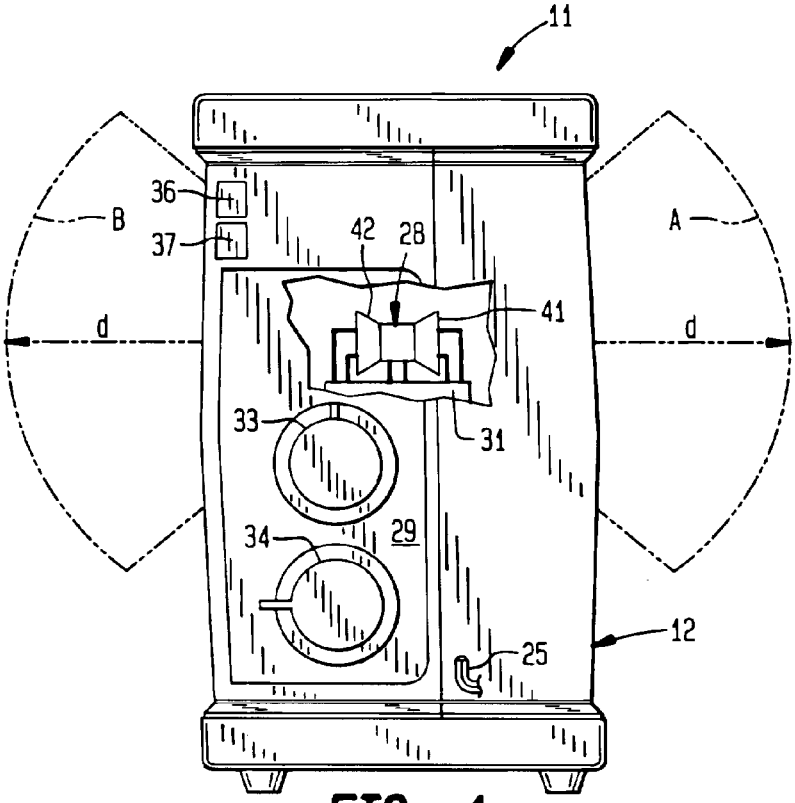
FIG. 4 is a partially broken away right side view of the device shown in FIG. 1.
Figure 5:
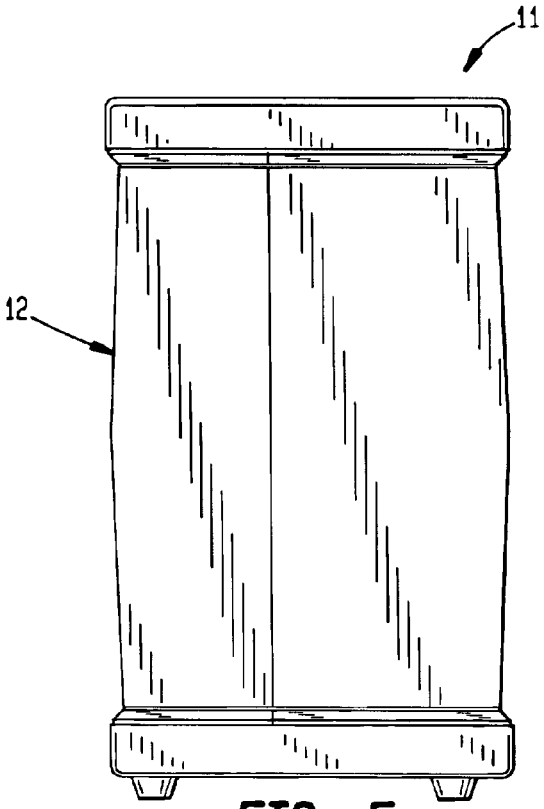
FIG. 5 is a left side view of the device shown in FIG. 1.

The sensor assembly 28 (FIG. 4) encompasses an inlet sensor 41 and an outlet sensor 42. Each of the sensors 41, 42 is a conventional proximity detector that produces an output signal in response to the presence of an object located within a certain predetermined distance d. The inlet and outlet sensors 41, 42 can be, for example, either the infrared or ultrasonic type. Such proximity sensors typically are directionally responsive and often provide a conical detection zone as depicted in FIG. 4. Thus, the inlet sensor 41 will produce an output signal in response to the presence of an object within a zone A adjacent to the inlet opening 18 and the outlet sensor 42 will produce an output signal in response to the presence of an object within a zone B adjacent to the outlet opening 19. The control circuit 31 (FIG. 5) includes a control relay 45 having a relay winding 46 and contacts 47 operated thereby, a fan switch 47 operated by the fan knob 33 and a heater switch 48 operated by the heater knob 34. Operating power for the inlet and outlet detectors 41, 42 is provided from the power cable 25 by lines 51. The relay winding 46 is connected in parallel across, respectively, output signal lines 52 from the inlet detector 41 and output signal lines 53 from the outlet detector 42. A manually operated deactivator switch 55 is connected between the inlet detector 41 and the relay winding 46. Connected in parallel in the control circuit 31 are a series circuit consisting of the fan motor 13, the fan switch 47 and the fan power lamp 36, and a series circuit consisting of the resistive heater element 15, the heater power lamp 37 and the heater switch 48. That parallel combination is connected to the power supply cord 25 by the contacts 47 of the control relay 45.

Prior to use of the device 11, the plug 26 is inserted into a conventional wall outlet (not shown). The control knobs 33, 34 then can be manipulated to establish a desired operational mode for the environmental conditioner 11. In a fan only operating mode, the knob 33 is used to close the fan switch 47 and thereby energize the electric motor 15. Resultant rotation of the fan blade 14 produces discharge of air from the outlet opening 19. Conversely, in a heater only mode, closure of the heater switch 48 with the knob 34 energizes the resistive heater element 13 to provide heating of air within the housing 12 for discharge from the outlet 19. Finally, a combination mode is established by closing both the fan switch 47 and the heater switch 48 to energize both the electric motor 15 and the resistive heater element 13. Resultant rotation of the fan blade 14 draws air in through the inlet opening 18 for discharge through the outlet opening 19 after being heated by the heater element 13 within the housing 12.

In response to the presence of an object within zone A, the inlet sensor 41 produces on lines 52 an output that energizes the winding 46 to open the normally closed contacts 47 and thereby interrupt and prevent further transmission of power to either the fan motor 13 or the heater element 15. Similarly, the presence of an object in zone B causes the outlet detector 42 to provide on lines 53 an output that energizes the relay winding 46 to open the contacts 47. Again, that occurrence interrupts and prevents any further power transmission to the heater element 13 or the fan motor 15. Thus, potentially unsafe operation of the device 11 is prevented by the presence of an object in either of the zones A or B. Such objects can include for example, an article which could undesirably obstruct the flow of air either into the inlet opening 18 or out of the outlet opening 19. The detectors 41, 42 and control circuit 31 also would deactivate the device 11 in response to a person such as a small child attempting to insert an object into the housing 12 through either the inlet grill 21 or the outlet grill 22. Electrical deactivation would occur similarly in the event that the device 11 is inadvertently tipped to produce blockage of the inlet 18 or outlet 19 by a supporting surface such as a floor.

Under certain conditions, deenergization of the device 11 may not be desired in response to the presence of an object in the inlet detection zone A. For example, the device 11 could be positioned with the inlet opening 18 closely adjacent to an object such as a wall or the like but not near enough to prevent an adequate supply of air from entering the inlet 18. In that case, the deactivator switch 55 can be manually opened to deactivate the inlet detector 41 and thereby prevent energization thereby of the relay winding 46. Desired transmission of power between the supply 25 and either one or both of the heater element 13 and the electric motor 15 then is possible through the closed contacts 47 and, respectively, the heater switch 48 and the fan switch 47.

Figure 7:
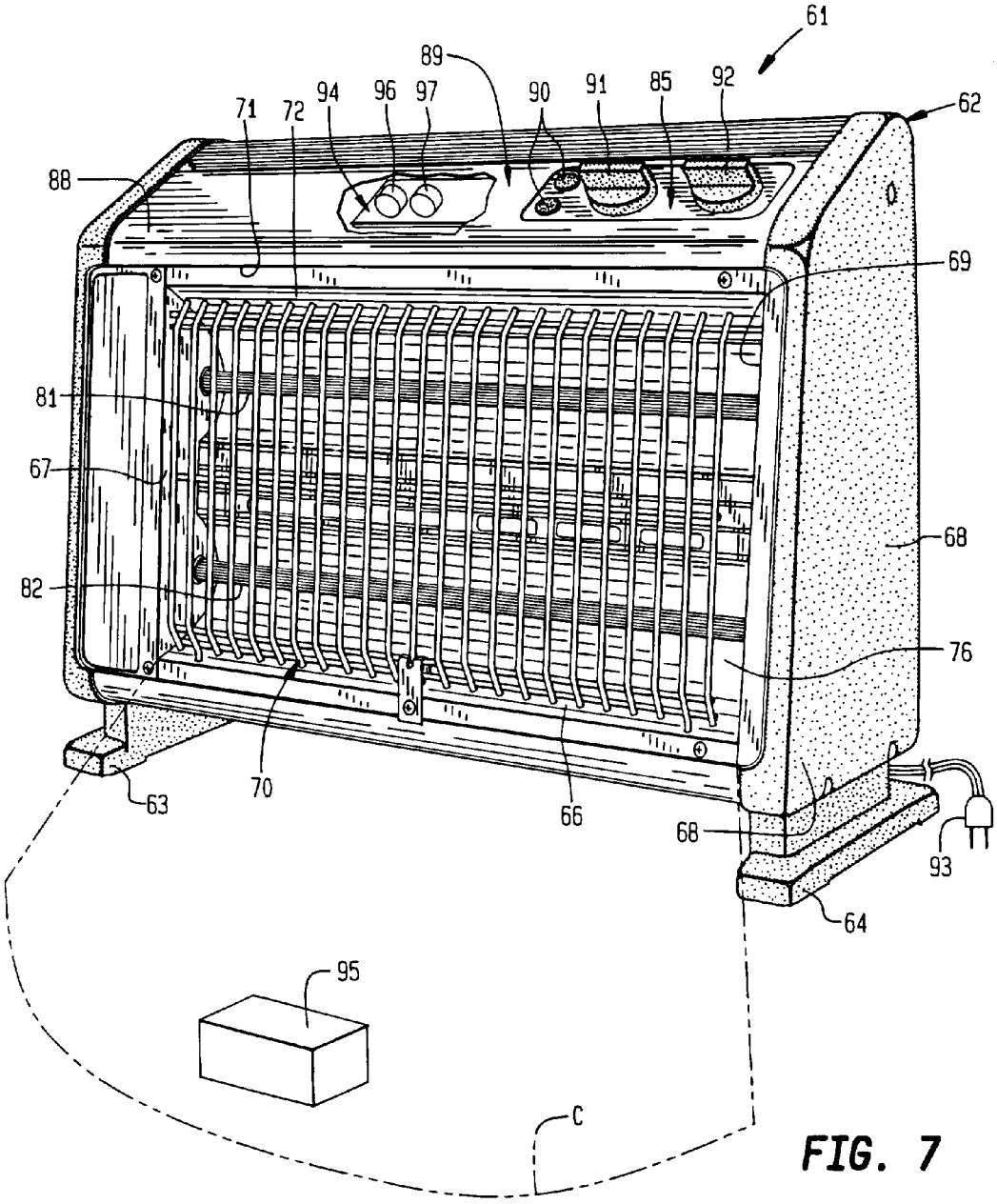
FIG. 7 is a perspective view of another embodiment.

Shown in FIG. 7 is a portable electrical radiant heater 61 which includes a portable housing 62 supported by a pair of legs 63, 64. Forming the housing 62 are a bottom wall 66, a pair of sidewalls 67, 68, an outlet 69 covered by a front grill wall 70, a top wall 71, and a rear wall 72. Also formed by the housing 62 is a cavity 76 defined by the bottom wall 66, the sidewalls 67, 68, the top wall 71, and the front grill wall 70.

Located within the cavity 76 closely adjacent to the rear wall 72 are a pair of vertically spaced apart, elongated and horizontally oriented quartz heater elements 81, 82. Opposite ends of the heater elements 81, 82, are supported by the sidewalls 67, 68. A housing 88 is supported by the top wall 71 and retains in a box 85 a control circuit 89 including signal lamps 90 and a pair of actuator switch knobs 91, 92.

Also included in the control circuit 89 and retained by the housing 88 is a proximity sensor unit 94 for detecting the presence of any object 95 in a predetermined zone C adjacent to outlet 69. Forming the sensor unit 94 is a conventional ultrasonic emitter 96 and a conventional ultrasonic detector 97. The emitter 96 directs ultrasonic energy into the zone C and the detector 97 detects ultrasonic energy reflected by objects 95 in the zone C. Power for operating the heater elements 81, 83, and the control circuit 89 is provided by a power cord with an electrical plug 93.

Prior to use of the device 61, the plug 93 is inserted into a conventional wall outlet (not shown). The control knobs 91, 92 then can be manipulated to establish a desired operational mode for the environmental conditioner 61. Operation of the knob 91 is used to energize either one or both of the heater elements 81, 82 producing transmission of radiant energy into the zone C. Also, ultrasonic waves are directed into the zone C by the emitter 96. Thermostatic control of temperature is established by operation of the knob 92.

In response to the presence of an object 95 within zone C, the detector 97 produces an output to interrupt transmission of power to either of the heater elements 81, 82 in the manner described above for embodiment 11. Thus, potentially unsafe operation of the device 61 is prevented by the presence of an object in the zone C. Such objects can include for example, an article which could undesirably obstruct the flow radiant energy out of the outlet opening 69. The detector 97 and control circuit 89 also would deactivate the device 61 in response to a person such as a small child attempting to insert an object into the housing 62 through the outlet grill 70. Electrical deactivation would occur similarly in the event that the device 61 is inadvertently tipped to produce blockage of the outlet 69 by a supporting surface such as a floor.

Obviously, many modifications and variations of the present invention are possible in light of the above teachings. It is to be understood, therefore, that the invention can be practiced otherwise than as specifically described.

What is claimed is:

1. An electric heater comprising:

portable housing means defining an outlet for transmitting environmentally conditioning heat energy;

electrically powered heater means retained by said housing and operable to transmit said heat energy through said outlet;

supply means for energizing said heater means;

switch means operable to activate said supply means to energize said heater means;

an electrical sensor for detecting a signal reflected by a stationary or moving object within a predetermined zone closely adjacent to said outlet; and a control for substantially instantaneously deenergizing said heater means in response to detection by said sensor of a stationary or moving object in said predetermined zone and thereby prevent unsafe operation of the heater.

2. An appliance according to claim 1 wherein said heater means comprises quartz rods.

3. An appliance according to claim 2 wherein said supply means comprises an electrical plug for insertion into an electrical outlet.

4. An appliance according to claim 3 including a grill covering said outlet.

5. An appliance according to claim 1 wherein said sensor means comprises an ultrasonic emitter and an ultrasonic detector.

6. An appliance according to claim 5 wherein said radiant heater means comprises quartz rods.

7. An appliance according to claim 6 wherein said supply means comprises an electrical plug for insertion into an electrical outlet.

8. An appliance according to claim 7 including a grill covering said outlet.

9. An appliance according to claim 1 wherein said sensor means comprises an infrared signal emitter and an infrared signal detector.

10. An appliance according to claim 9 wherein said supply means comprises an electrical plug for insertion into an electrical outlet.

11. An appliance according to claim 10 wherein said sensor means comprises an ultrasonic emitter and an ultrasonic detector.

12. An appliance according to claim 11 wherein said heater means comprises quartz rods.

13. An electric appliance comprising:

portable housing means defining an inlet for passing air thereinto and an outlet for discharging air therefrom, said outlet facing substantially opposite to said inlet;

an electrically powered environmental conditioner device retained by said housing means, said conditioner device operable to produce air flow through said housing means;

supply means for transmitting electrical power to said conditioner device, said supply means comprising an electrical plug for insertion into an electrical outlet socket;

a sensor means comprising an outlet detector for detecting the presence of a stationary or moving object within an outlet zone projecting away from said outlet and an inlet detector for detecting the presence of a stationary or moving object within an inlet zone projecting away from said inlet; and a control for substantially instantaneously interrupting the transmission of electrical power between said supply means and said conditioner device in response to detection of an object by said inlet detector or said outlet detector.

14. An appliance according to claim 13 wherein each said inlet and said outlet is covered by a grill, and said control comprises a deactivator for deactivating said inlet detector.

15. An appliance according to claim 13 wherein said conditioner device comprises a rotatable fan blade for circulating air through said housing and an electric motor operatively coupled to said fan blade, and said electric motor is interconnected with said control and said supply means.

16. An appliance according to claim 15 wherein said control comprises means operable to prevent the flow of electrical power to said conditioner device in response to detection of an object by said sensor means.

17. An appliance according to claim 13 wherein said conditioner device comprises an electric heater element for heating air within said housing means.

18. An appliance according to claim 17 wherein said control comprises means operable to prevent the flow of electrical power to said conditioner device in response to detection of an object by said sensor.

19. An appliance according to claim 17 including fan means for circulating air by said heater element and between said inlet and said outlet.

* * * * *